US006666776B2

(12) United States Patent
Yamaguchi

(10) Patent No.: US 6,666,776 B2
(45) Date of Patent: Dec. 23, 2003

(54) TEE DEVICE FOR SPORT PRACTICE

(75) Inventor: Hideo Yamaguchi, Osaka (JP)

(73) Assignee: Terry Whitfield, Millbrae, CA (US)

( * ) Notice: Subject to any disclaimer, the term of this patent is extended or adjusted under 35 U.S.C. 154(b) by 0 days.

(21) Appl. No.: 10/113,973

(22) Filed: Mar. 29, 2002

(65) Prior Publication Data

US 2003/0186752 A1 Oct. 2, 2003

(51) Int. Cl.[7] ..... A63B 69/36
(52) U.S. Cl. ..... 473/134; 473/135
(58) Field of Search ..... 473/132–137, 473/418, 419, 420

(56) References Cited

U.S. PATENT DOCUMENTS 2,618,480 A * 11/1952 Williams ..... 473/135
2,643,883 A * 6/1953 Hogeberg ..... 473/135
3,778,067 A * 12/1973 Gentiluomo ..... 473/133
4,017,087 A * 4/1977 Bruno ..... 473/133
4,319,753 A * 3/1982 Mann ..... 473/133
5,078,401 A * 1/1992 Fehrenbach et al. ..... 473/133
5,282,629 A * 2/1994 Eckstein ..... 473/133
5,643,096 A * 7/1997 Lowe ..... 473/135
5,662,526 A * 9/1997 Sutherlin ..... 473/135

* cited by examiner

*Primary Examiner*—Steven Wong
(74) *Attorney, Agent, or Firm*—Law Offices of Terry McHugh

(57) ABSTRACT

An automated tee device uses air pressure through a tee to determine whether a ball is rested on the tee or whether a next ball should be supplied. When a ball is in a rest position on the tee, the airflow through a passage within the tee is inhibited. Consequently, by determining the current condition of airflow through the tee, it can be determined whether a ball is rested on the tee or whether a next ball should be supplied. In accordance with a second aspect of the invention, the tee can be adjusted to any height within a preselected vertical range. Upper and lower limit switches reverse the adjustment of a tee height in response to determining that the upper or the lower limit of the range has been reached. The automated tee device may be used in sports such as golf, baseball and softball.

11 Claims, 3 Drawing Sheets

TEE DEVICE FOR SPORT PRACTICE

TECHNICAL FIELD

The invention relates generally to tee devices for practicing a sport, such as golf, and more particularly to technologies for verifying that a ball is placed on a tee device and for allowing the height of the ball to be easily adjusted.

BACKGROUND ART

Tee devices are used in various sports to practice hitting skills. For example, tee devices commonly are used in baseball, softball and golf. Typically, the participant must manually set the ball on the device, but the benefits of a practice sessions are increased if an automated ball supply mechanism is used to replace a ball after each swing.

Often, a detection system is included within an automated ball supply mechanism to confirm that a ball has been placed on a tee device. In a golf practice device for a driving practice range, a reflecting type of photocell may be used. The photocell emits light to a golf ball placed on a tee and receives reflected light. When the reflected light is detected, a ball-confirmation signal is transmitted to a control device, which causes a ball supply arm to reset so as to draw away from the tee. This stops the next ball from being supplied. If the reflected light is not received within a preselected period of time, the photocell system emits a ball-unconfirmed signal to the control device, which then causes the ball supply arm to draw near the tee and supply the next ball. For tee devices that reside below a floor level, the supply operation may also include moving the tee device upwardly and downwardly relative to the floor level.

An alternative golf ball confirmation approach is to connect the tee to a weight sensor or a load sensor. When a golf is placed on the tee, the sensor detects the increase in weight. The sensor then transmits a ball-confirmation signal, similar to the photocell approach. Automated supply operations may be identical to the ones described with reference to the use of the photocell.

While the prior art approaches operate reasonably well for their intended purposes, there are concerns. For example, in a driving range environment, the automated devices are exposed to rain. Moreover, dust accumulates and light may be inadvertently blocked. Another concern is that direct sunlight will reflect off the ball and may lead to false readings by the photocell system. For the weight sensor approach of ball confirmation, malfunctions may occur when the tee is inadvertently touched. Particularly, when a ball is supplied at a level below a floor, there are experiences of malfunctions as a result of age deterioration as the tee is regularly raised and lowered. Resistance from the accumulation of dirt and the like is also a cause of malfunctions. Finally, the weight sensors may be susceptible to false readings as a result of the differences in weights of practice balls and some official balls.

An object of the invention is to provide a key device for sports practice, where the tee device has an automated system with a low susceptibility to malfunctions and false readings. Another object is to provide a tee device that enables mechanized manipulation of ball height.

SUMMARY OF THE INVENTION

An automated tee device utilizes air pressure to determine when a next ball should be supplied to a ball-seating end of a tee. The tee includes an air passageway to an outlet at the ball-seating end. The air passageway is connected to a supply of pressurized air which has a pressure that is less than the gravitational force of a ball at rest on the ball-seating end of the tee. In one application, the ball-seating end is configured to support a golf ball. A detector monitors airflow through the air passageway and outputs a signal that is indicative of the current condition of airflow. This signal is transmitted to a controller which triggers automated operations on the basis of the current state of the signal.

The controller may be a central processing unit (CPU) that operates a ball supply mechanism for automatically feeding balls to the ball-seating end of the tee. In some applications, the ball is supplied at a sub-floor level, so that the controller cooperates with the detector to determine when the tee should be lowered to receive the next ball.

The detector may include a movable member having a rest position and a displaced position. The movable member should be located along the airflow path from the airflow supply to the ball-seating end of the tee. The movable member is forced by airflow from its rest position to its displaced position when there is no ball at rest on the ball-seating end. The detector also includes a sensor which monitors the position of the movable member and outputs a signal on the basis of the current position.

The movable member may be a butterfly board that is oriented to inhibit airflow when the butterfly board is in its rest position. However, when a ball is removed from the ball-seating end of the tee, airflow forces the butterfly board to the displaced position. An optical sensor may be used to determine the position of the butterfly board.

As another aspect of the invention, the automated tee device may include a height adjustment system. In accordance with this aspect, the height adjustment system includes a motor connected to the tee to adjust a vertical position of the ball-seating end to any position within a preselected vertical range. An activation switch turns the motor on and off. An upper limit switch is mechanically associated with the tee and electrically associated with the motor to automatically reverse the direction of the motor in response to the ball-seating end reaching an upper vertical limit of the range. Similarly, a lower limit switch is mechanically associated with the tee and electrically associated with the motor to again reverse the direction of the tee adjustment in response to the ball-seating end reaching a lower vertical limit within the range.

An advantage of the invention is that the air pressure detection provides a reliable indication of the presence or absence of a ball on the tee. The ball may be a golf ball, but can also be a baseball, a softball, or the like. Another advantage of the invention is that the automated tee device is easily maintained, since the sensing capability is housed within the airflow path and is therefore not directly exposed to the environment. Another advantage is that the height of a ball can be readily adjusted to fit the preferences of the users.

DETAILED DESCRIPTION

Figure 1:
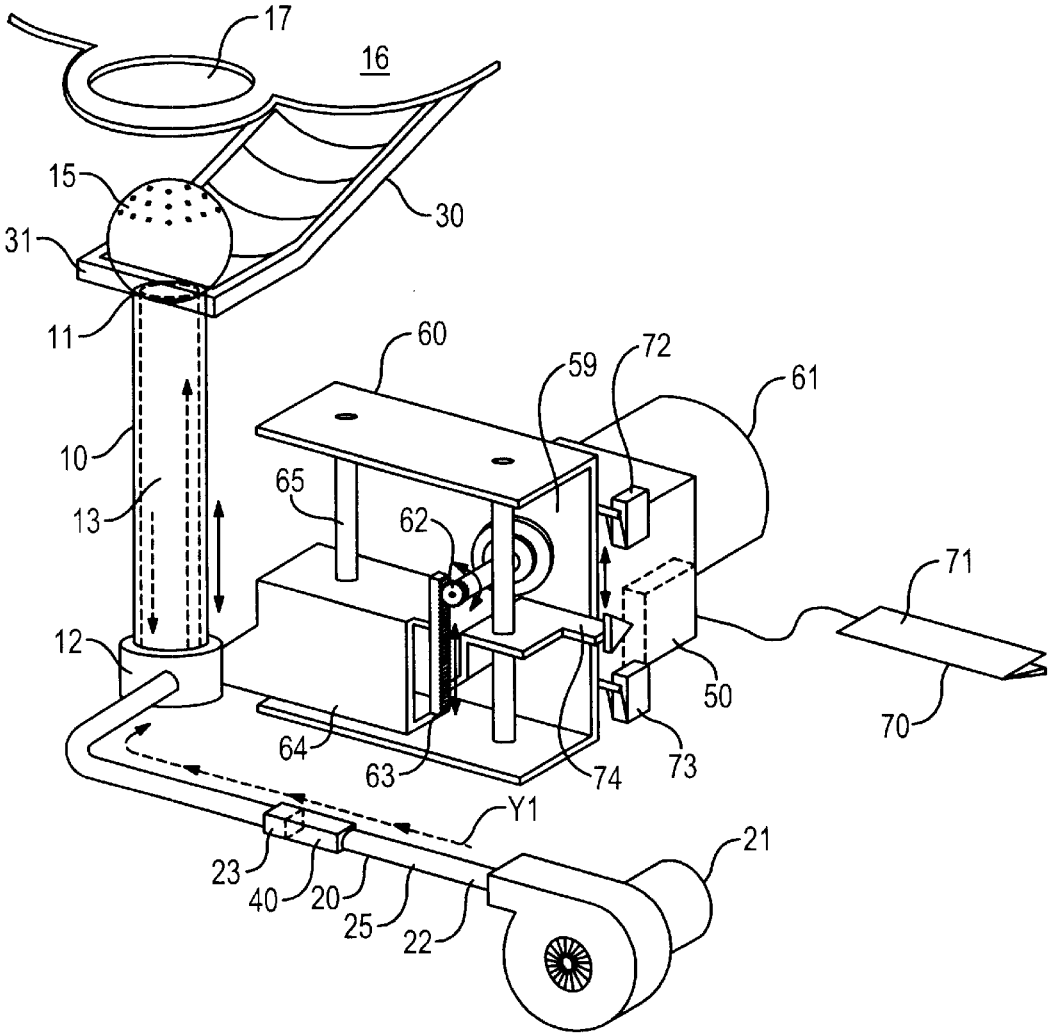
FIG. 1 is a perspective view of a tee device for golf practice in accordance with one embodiment of the invention.

With reference to FIG. 1, a tee device for golf practice is built into a golf practice bay of a driving range. A golf ball 15 is supplied onto a tee 10 when the tee is below a floor 16 having an opening 17. When the golf ball is loaded onto the tee, the tee rises through the opening in the floor, until the ball reaches a driving position.

The tee is made of a flexible material, such as a urethane rubber having a highly elastic restoring nature. The tee has a cylindrical shape with a vertical passageway 13 that is exposed on the upper end 11 (i.e., ball-seating end) of the tee. The lower end of the tee is closed with a cap 12. The tee device also includes an airflow supply portion 20 which is connected to the cap 12 to supply a flow of air through the vertical passageway 13 within the tee 10.

A golf ball supply path 30 is used to guide the golf ball 15 to the top of the tee 10. While not fully shown in FIG. 1, the end 31 of the supply path includes a stop gate which is used to control a position of the golf ball relative to the upper end 11 of the tee. The stop gate may be a mechanical device, or may be an electrical device controlled by a central processing unit (CPU) 50. The CPU also controls a system 60 for raising and lowering the tee.

Figure 2:
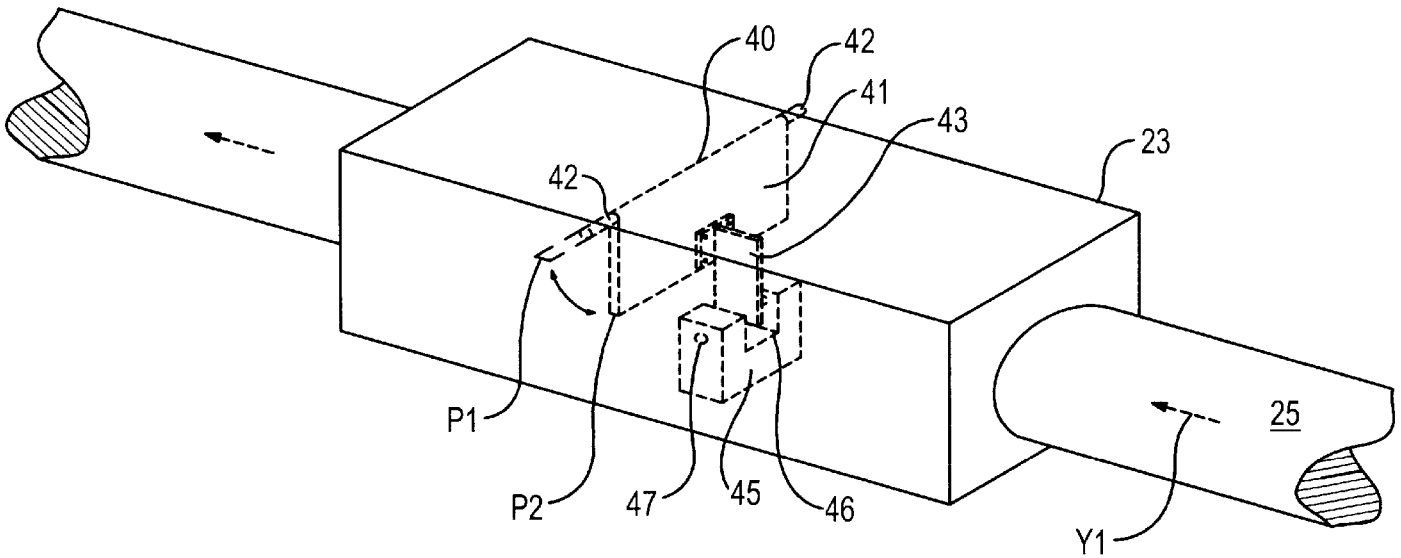
FIG. 2 is a perspective view of an airflow detection system for the golf tee device of FIG. 1.

Referring now to FIGS. 1 and 2, an airflow detector 40 is used to monitor airflow within an internal passage 25 of a tube 22 that is part of the airflow supply portion 20. When there is no golf ball 15 on the upper end 11 of the tee 10, the airflow detector 40 will detect a flow of air through the tube 22. On the other hand, when the golf ball 15 is resting on the upper end of the tee, airflow will be inhibited and the appropriate detection signal will be transmitted to the CPU 50. A mini-blower 21 generates a small pressure airflow to the tube 22. The airflow passes through a detection box 23 having the detector 40 and proceeds to the vertical passageway 13 through the tee, as indicated by arrow Y1. The detection box is a hollow rectangular member that may be formed with the tube as a single piece. A separate mini-blower may be provided for each tee device of a driving range or the driving range may have a single mini-blower that provides a flow that is distributed to the various tee devices of the range. Optionally, an air filter may be provided within the airflow passage portion 20.

The airflow detector 40 includes a butterfly board 41 that is mounted to swing in response to the flow of air through the detection box 23. The butterfly board is shown in a rest position (P2) that indicates a lack of airflow, but FIG. 2 also includes a phantom drawing of the butterfly board in an airflow-presence position (P1). The butterfly board 41 is mounted within the detection box 23 using rods 42, which define the swing axis of the butterfly board. The board remains in a rest position as a result of its weight, unless air pressure overcomes the weight of the board.

A small board-shaped protrusion 43 extends from the center of the butterfly board 41. The protrusion is shown in a light-blocking position relative to an optical sensor unit 45. In this position, the optical sensor unit will generate an airflow-stoppage detection signal. The optical sensor unit comprises a concave-shaped support platform 46 having a cavity aligned with the swingable board-shaped protrusion 43. A photocell 47 is positioned at the support platform such that the optical emission portion and the optical receiving portion face each other. Consequently, when the protrusion is positioned as shown in FIG. 2, light passage is blocked.

The butterfly board 41 is mounted using the rods 42 such that the butterfly board is able to rotate relative to the opposite walls of the airflow detection box. The dimensions of the butterfly board are smaller than the cross sectional dimensions of the interior of the detection box. The concave support platform 46 is removably attached to the bottom floor of the detection box, so that maintenance is easy to implement. While the embodiment is shown as having a transparent type photocell 47, a reflective type photocell may be positioned directly on a sidewall of the detection box, so that the support platform is not critical to the invention. Moreover, other types of sensors may be adapted in place of the optical sensor. For example, an electrical field sensor, a magnetic sensor, or an ultrasound wave sensor may be used without diverting from the invention. As another possible approach, the detection box 23 may be omitted and a circular butterfly board may be supported to swing inside the tube 22, with the optical sensing capability also being provided within the tube.

The golf ball supply path 30 of FIG. 1 may be formed as a means to place golf balls 15 on the tee 10. The supply path includes a sloping runway from a ball hopper (not shown) which holds numerous golf balls for use in practice. The ball stop gate limits the supply to a single ball at a time. The end 31 of the supply path defines a positioning frame to stably load a golf ball when the tee is in its ball transfer position. When the golf ball 15 is placed at the upper end 11 of the tee, the airflow detector 40 recognizes that the airflow through the detection box 23 has ceased, and an appropriate airflow stoppage detection signal is generated by the photocell 47. The signal is transmitted to the CPU 50, which closes the gate that would otherwise supply the next golf ball. It is not until the golf ball has been removed from the upper end 11 of the tee that the next golf ball will be allowed to progress.

The tee raising and lowering system 60 includes a reversible motor 61 mounted on a sidewall of a bracket 59. A vertical rack 63 meshes with a pinion gear 62 fixed to an output axis of the reversible motor. When the pinion gear 62 is rotated, the rack is moved upwardly or downwardly, depending upon the direction of rotation of the pinion gear. A vertical slider 64 is fixed to the rack and moves upwardly and downwardly along a stationary guide 65 attached to the bracket 59. The tee 10 is attached to the slider 64 for movement with the slider. In operation, when a golf ball 15 is placed on the upper end 11 of the tee, the airflow detector 40 detects that the flow of air within the internal passage 25 of the airflow supply portion 20 has stopped. In response, the airflow-stoppage detection signal is generated by the photocell 47 and is transmitted to the CPU 50. The CPU triggers operation of the reversible motor in order to raise the position of the tee 10.

Figure 3:
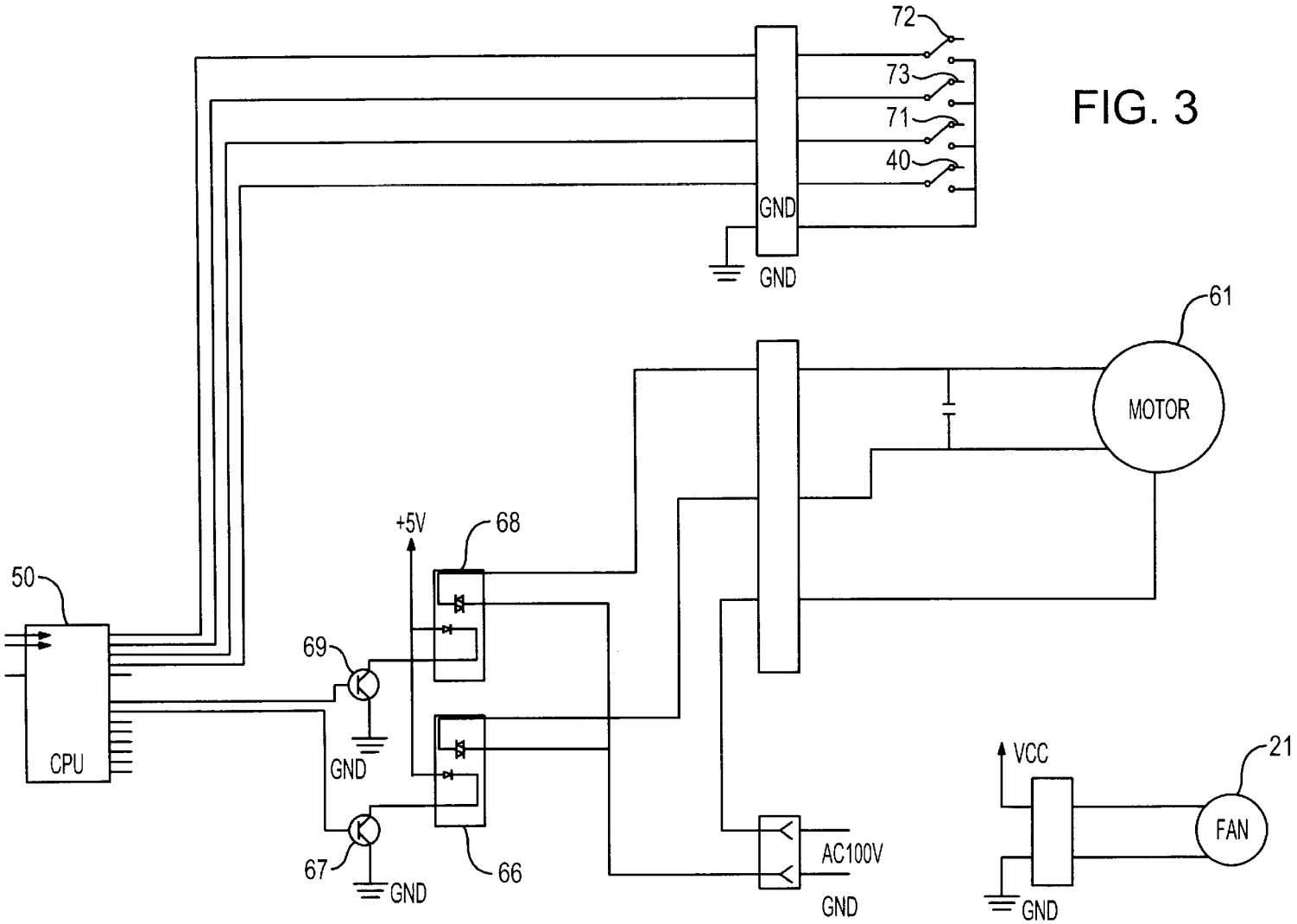
FIG. 3 is a schematic diagram of electrical components of the tee device of FIG. 1.

Referring to FIGS. 1 and 3, the CPU causes the motor 61 to run in a forward direction by controlling a relay 68 via a transistor 69. The golf ball then rises through the opening 17 within the floor 16, allowing a golfer to drive the ball from the tee 10. When the golf ball is removed from the tee, airflow again occurs within the detection box 23, causing the detector 40 to generate an airflow detection signal that is received by the CPU. The CPU triggers backward operation of the motor by activating a second relay 66 via a second transistor 67. As a result, the tee is lowered to the position shown in FIG. 1.

In addition to the sub-floor embodiment of FIG. 1, the invention may be used to supply golf balls onto tees above a floor level. For example, a ball supply arm may swing to and from the position of the tee, so that the supply arm has a lowered position for feeding golf balls and a raised position to allow a golf ball to be driven.

In general, there is a significant height difference from the tee height for the driver and the tee height for the pitching wedge, but adjustment of the tee height can be carried out using the same method that was described for supplying balls beneath the floor. In FIG. 1, a tee height adjustment member may be used. The tee height adjustment member 70 of FIGS. 1 and 3 includes a push switch 71, the CPU 50, the tee raising and lowering system 60, an upper limit switch 72 and a lower limit switch 73. When the main switch 71 is pressed with a golf club, a foot, or the like, the CPU 50 causes the reversible motor 61 to advance forwardly, thereby setting the tee 10 at a higher desired height. However, continuous pressing of the main switch 71 causes a protrusion 74 fixed to the vertical slider 64 to press the upper limit switch 72. The activation of the upper limit switch causes the reversible motor 61 to reverse in direction, so that the tee will descend to a desired lower position if the pressure on the main switch 71 is released. Without releasing the main switch, the motor will continue until the protrusion 74 depresses the lower limit switch 73, causing the reversible motor to again run forwardly.

The attachment positions of the upper limit switch 72 and the lower limit switch 73 can be adjusted to meet the preferences of users. Moreover, the shape of the vertical slider 64 can be changed to accommodate the airflow detector 40 and the mini-blower 21. Thus, the tee device may be formed in a single unit. The position of the airflow detection box 23 in the tube 22 should then be moved to the end part closest to the mini-blower, so that only the tee 10 and the link to the tube 22 are disposed outside of the frame. This protects the airflow detector and the mini-blower, as well as other structural parts of the tee device.

As is clear from the description, the tee device for golf practice is comprised of a cylindrical tee 10 in an upright position, with a vertical passageway 13 extending to an open upper end 11. An airflow supply mechanism 21 provides airflow through the passageway inside the tee. A golf ball setting mechanism 30 for placing a golf ball on the tee is controlled by a detection arrangement 40 for (1) detecting when a golf ball has been placed on the upper end of the tee and (2) detecting when the golf ball is no longer present on the tee. The detection steps are implemented by monitoring airflow through the tee using the detector 40. Placing a golf ball on the upper end of the tee substantially stops the airflow through the tee, causing the butterfly board 41 to move to the rest position P2. As a result, the CPU 50 will receive an airflow-stoppage detection signal. This signal causes the CPU to activate the motor 61 to move the tee until the golf ball 15 is above the level of the floor 16. When the golf ball is struck by a golf club, airflow through the tee will return, causing the detector 40 to transmit an airflow detection signal that results in lowering of the tee by the motor.

In the described embodiment of the invention, the detector 40 includes a moving member that is responsive to airflow. When the moving member is in a rest position, the airflow-stoppage detection signal is transmitted. On the other hand, when air pressure causes the moving member to be displaced, the airflow detection signal is generated. The position of the moving member can easily be detected by using an optical sensor, but other sensors may also be used.

The moving member that has been described includes a butterfly board 41 that is supported to swing relative to an axis defined by support rods 42. The butterfly board includes a perpendicular protrusion 43 that blocks the passage of light when the butterfly board is in the rest position. This construction is convenient, has a high reliability, and is easily maintained. Testing is made easy by allowing the support rods to extend to the exterior of the detection box 23, allowing a person to manually rotate the butterfly board. Moreover, the optical sensor unit 45 is easily removed and replaced.

The golf ball setting arrangement of the invention is controlled by the airflow-stoppage detection signal. Golf ball setting operations are suspended until a set golf ball is no longer on the upper end 11 of the tee 10. Thus, until the golf ball is removed from the tee, any placement operations of another golf ball are stopped.

As another aspect of the invention, the motor 61 may be used to adjust the position of the ball. The pressing of the main switch 71 will cause the ball to rise relative to the floor 16 until the switch is released or the contact of a protrusion 74 with an upper limit switch 72 reverses the motor. Similarly, when the motor is reversed, the golf ball will continue to descend until the main switch 71 is released or the protrusion 74 contacts the lower limit switch 73 that reverses motor direction.

While the invention has been described and illustrated with reference to use with a golf ball tee device, the invention may be used in other applications. For example, monitoring airflow through a tee device may be used in baseball and softball tee devices for practicing hitting.

What is claimed is:

1. An automated tee device comprising:

a tee having a ball-seating end and having an air passageway extending within said tee to said ball-seating end;

a supply of pressurized air connected to said air passageway to supply airflow having a pressure less than a gravitational force of a ball at rest on said ball-seating end;

a detector configured to monitor airflow through said air passageway, said detector having a signal output that is indicative of a current condition of airflow through said air passageway; and a controller configured to control automated operations in response to said signal output;

wherein said detector includes a movable mechanical member having a rest position and having a displaced position, said movable mechanical member being located along an airflow path from said supply to said ball-seating end of said tee such that said movable mechanical member is forced by said airflow from said rest position to said displaced position when there is no ball at rest on said ball-seating end, said detector further including an optical sensor that is positioned to monitor movement of said movable mechanical member, said optical sensor generating an airflow-stoppage detection signal when said movable mechanical member is in said rest position.

2. The automated tee device of claim 1 wherein said controller is connected to a ball supply mechanism for automatically feeding balls to said ball-seating end of said tee, said controller being responsive to said signal output of said detector.

3. The automated tee device of claim 1 wherein said movable mechanical member is a butterfly board oriented to inhibit said airflow when said butterfly board is in said rest position.

4. The automated tee device of claim 1 further comprising a motor connected to said tee for controlling vertical positioning of said ball-seating end.

5. The automated tee device of claim 4 wherein said motor is a component of a height adjustment system that includes an activation switch connected to said motor to activate said motor, said height adjustment system further including an upper limit switch and a lower limit switch, said upper limit switch being positioned to reverse a direction of said motor when said ball-seating end reaches a preselected upper limit and said lower limit switch being positioned to reverse the direction of said motor when said ball-seating end reaches a preselected lower limit, said motor being responsively controlled by manipulation of said activation switch during a full range of movement of said ball-seating end between said preselected upper and lower limits. such that said manipulation of said activation enables a user to select a position of said ball-seating end anywhere within said range.

6. The automated tee device of claim 1 wherein said controller is a central processing unit that receives electrical signals form said detector.

7. The automated tee device of claim 1 wherein said tee is configured to support a golf ball.

8. An automated tee device comprising:

a tee having a ball-seating end configured to support a ball;

a motor connected to said tee to adjust a vertical position of said ball-seating end to any position within a preselected vertical range;

an upper limit switch mechanically associated with said tee and electrically associated with said motor to automatically reverse a direction of tee adjustment in response to said ball-seating end reaching an upper vertical limit in said preselected vertical range; and a lower limit switch mechanically associated with said tee and electrically associated with said motor to reverse a direction of said tee adjustment in response to said ball-seating end reaching a lower vertical limit in said preselected vertical range;

wherein said motor is a reversible motor and said upper and lower limit switches trigger reversals of motor rotation.

9. The automated tee device of claim 8 further comprising a ball supply system having a detector which monitors airflow through said ball-seating end from a source of pressurized air, said detector generating a signal to suspend ball replacement operation when said airflow is restricted by a ball rested on said ball-seating end.

10. The automated tee device of claim 8 further comprising an activation switch connected to said motor to selectively activate said motor.

11. The automated tee device of claim 8 wherein said ball-seating end is configured to support a golf ball.

* * * * *